US006167372A

United States Patent [19]

Maeda

[11] Patent Number: 6,167,372

[45] Date of Patent: Dec. 26, 2000

[54] SIGNAL IDENTIFYING DEVICE, CODE BOOK CHANGING DEVICE, SIGNAL IDENTIFYING METHOD, AND CODE BOOK CHANGING METHOD

[75] Inventor: Yuji Maeda, Tokyo, Japan

[73] Assignee: Sony Corporation, Tokyo, Japan

[21] Appl. No.: 09/111,403

[22] Filed: Jul. 7, 1998

[30] Foreign Application Priority Data

Jul. 9, 1997 [JP] Japan ..... 9-183498

[51] Int. Cl.[7] ..... G10L 13/02

[52] U.S. Cl. ..... 704/207; 704/219; 704/220

[58] Field of Search ..... 704/219, 240, 704/207–210, 221, 220

[56] References Cited

U.S. PATENT DOCUMENTS 4,541,110 9/1985 Hopf et al. ..... 704/208
4,542,525 9/1985 Hopf ..... 704/208
5,298,674 3/1994 Yun ..... 704/208
5,375,188 12/1994 Serikawa et al. ..... 704/210
5,712,953 1/1998 Langs ..... 704/208
5,778,335 7/1998 Ubale et al. ..... 704/219
5,809,472 9/1998 Morrison ..... 704/500

*Primary Examiner*—David R. Hudspeth
*Assistant Examiner*—Daniel Abebe
*Attorney, Agent, or Firm*—Jay H. Maioli

[57] ABSTRACT

A signal identifying device which can identify an input signal easily includes a pitch extracting (4Y) for extracting a pitch component of the input signal (S1), and energy calculating unit (4X) for calculating an energy component of the input signal, and identifying unit (4Z) for executing a predetermined operation to the pitch component and the energy component and for identifying whether the input signal is a voice signal or music signal. The voice signal generally has the characteristics evident in energy, and has strong periodicity (i.e., pitch component) comparing compared to the music signal.

12 Claims, 6 Drawing Sheets

SIGNAL IDENTIFYING DEVICE, CODE BOOK CHANGING DEVICE, SIGNAL IDENTIFYING METHOD, AND CODE BOOK CHANGING METHOD

BACKGROUND OF THE INVENTION

1. Field of the Invention

This invention relates to a signal identifying device, a code book or codec changing device, a signal identifying method, and a code book or codec changing method, and more particularly, is applicable to a coding apparatus which can identify input signal and change code book used for coding or codec.

2. Description of the Related Art

Conventionally, techniques for compressive coding input signal such as voice signal at low bit rate have been proposed. A typical technique of signal coding at low bit rate is vector quantization. The most important characteristic of this vector quantization is in a point that while the conventional coding methods processes input signal as scalar amount, this vector quantization processes input signal as vector amount.

The vector quantization will be explained more concretely here. In the conventionally proposed coding methods such as Multiband excitation (MBE) coding, Singleband excitation (SBE) coding, Harmonic coding, Sub-band coding (SBC), Linear Predictive coding (LPC), or Discrete cosine transform (DCT), Modified DCT (MDCT), spectrum amplitude and other parameters obtained from input signal are used as information data and are processed as a scalar-amount to be quantized.

On the contrary, in the vector quantization, various information data obtained from input signal are not quantized as a scalar-amount individually, but a vector is respectively formed from a combination of several information data and information representing the vector (e.g., vector number) is coded. Accordingly, the vector quantization has the effects that bit rate can be remarkably lowered and quantization efficiency can be improved significantly, comparing to the case of the scalar quantization.

To practically realize the vector quantization, a plurality of typical vectors to which vector numbers are put are previously stored in a storing circuit such as a memory (hereinafter, the storing circuit in which the typical vectors are stored is referred to as code book.) which is prepared in a coding apparatus. In the coding apparatus, a vector is formed from a combination of several information data obtained from input signal, and the typical vector most similar to this vector is retrieved from the code book, and the vector number of the most similar typical vector is read to be coded. Thereby, only if the code book is prepared previously, the vector quantization can be realized easily.

In addition, in a decoding apparatus, if the same code book as the code book prepared in the coding apparatus is prepared, the corresponding typical vector is read from the code book based on the sent coded data (i.e., data of which vector number is coded), so as to easily perform decoding.

On the other hand, the input signal to be coded generally has the different characteristics depending on the signal type. When the vector quantization is performed, it is desired that the typical vector prepared as code book is a vector suitable for the characteristics of the input signal, also in order to reduce distortion generated by quantization. In other words, if the typical vector suitable for the characteristics of the input signal is prepared as code book, the coding characteristically suitable for the input signal can be performed. For instance, if the typical vector suitable for voice signal is prepared in the code book, the coding characteristically suitable for the voice signal can be realized, and if the typical vector suitable for music signal is prepared in the code book, the coding characteristically suitable for the music signal can be realized.

In connection, the voice signal described here is such signal that a main signal component is formed by "voice produced by the vibration of the human's vocal cords". The music signal is such signal that a main signal component is formed by "sound produced from one or more musical instruments".

Thereby, the code book suitable for this voice signal and the code book suitable for this music signal are prepared in the coding apparatus, and a user changes the code book or codec in accordance with the type of input signal, so as to perform coding with high grade suitable for the characteristics of input signal.

In the conventional coding apparatus, the code books suitable for the voice signal and the music signal are prepared so as to perform coding suitable for the characteristics of input signal. However, the apparatus is so designed that a user identifies input signal and changes the code book or codec. So, there is a problem that the user has to identify input signal and has to change the code book or codec. In other words, if input signal is automatically identified, usage of the apparatus will be improved significantly for users.

SUMMARY OF THE INVENTION

In view of the foregoing, an object of this invention is to provide a signal identifying device which can easily identify input signal, a code book or codec changing device using this device, a signal identifying method, and a code book or codec changing method.

The foregoing object and other objects of the invention have been achieved by the provision of a signal identifying device which comprises: pitch extracting means for extracting pitch component that input signal has; energy calculating means for calculating energy component that input signal has; and identifying means for performing a predetermined operation on the pitch component and the energy component and for identifying whether input signal is voice signal or music signal based on the operated result.

Further, according to this invention, a code book or codec changing device comprises: pitch extracting means for extracting pitch component that input signal has; energy calculating means for calculating energy component that input signal has; identifying means for performing a predetermined operation on the pitch component and the energy component and for identifying whether input signal is voice signal or music signal based on the operated result; and changing means for changing the first code book or codec characteristically suitable for the voice signal and the second code book or codec characteristically suitable for the music signal in accordance with the identified result of the identifying means.

Further, in the present invention, pitch component that input signal has is extracted, energy component that input signal has is calculated, and a predetermined operation is performed on the pitch component and the energy component to identify whether input signal is voice signal or music signal based on the operated result.

Further, in this invention, pitch component that input signal has is extracted, energy component that input signal has is calculated, a predetermined operation is performed on the pitch component and the energy component to identify whether input signal is voice signal or music signal based on the operated result, and the first code book or codec characteristically suitable for the voice signal and the second code book or codec characteristically suitable for the music signal are changed in accordance with the identified result.

When comparing the voice signal and the music signal, the voice signal generally has the characteristics in energy, and has strong periodicity (i.e., pitch component) comparing to the music signal. For this reason, pitch component that input signal has is extracted and energy component that input signal has is calculated, and a predetermined operation is performed on the pitch component and the energy component to identify whether the input signal is voice signal or music signal, so that the type of input signal can be identified easily.

Also, the first code book or codec characteristically suitable for the voice signal and the second code book or codec characteristically suitable for the music signal are changed in accordance with the result that the input signal is identified, so that a user can use the code book or codec appropriate for the input signal without the complicated operation for changing, and can perform a coding processing with high grade.

The nature, principle and utility of the invention will become more apparent from the following detailed description when read in conjunction with the accompanying drawings in which like parts are designated by like reference numerals or characters.

DETAILED DESCRIPTION OF THE EMBODIMENT

Figure 1:
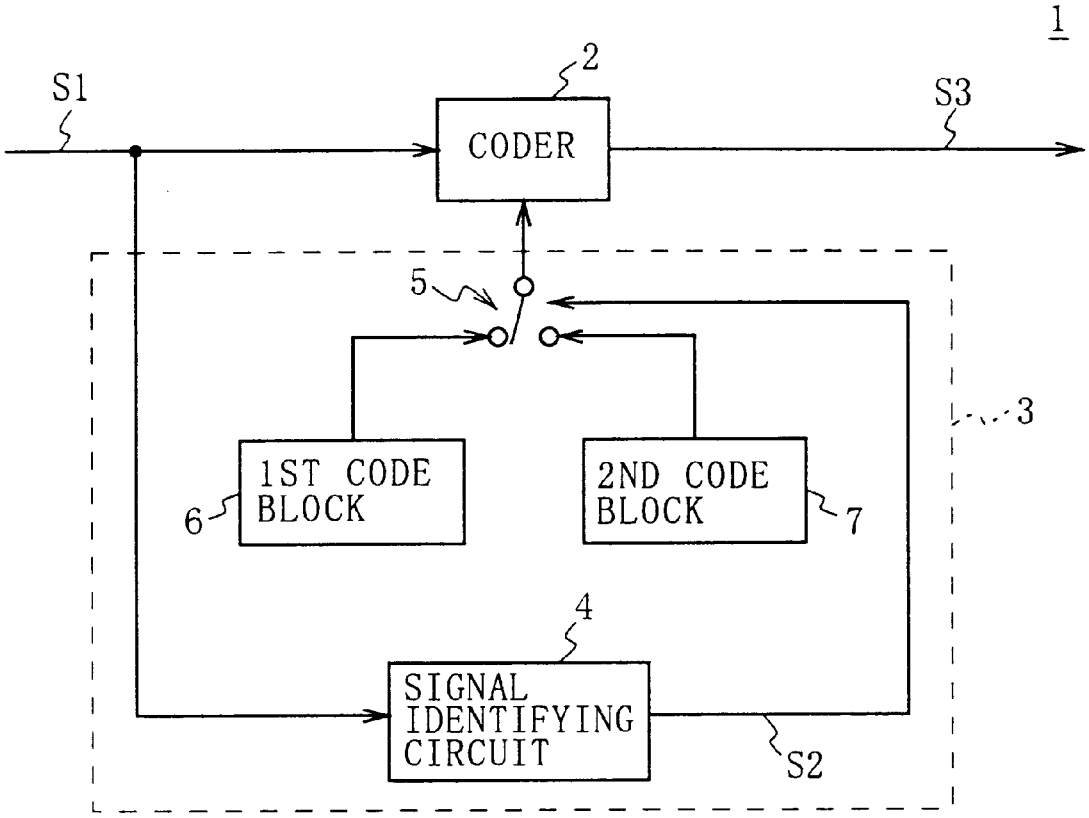
FIG. 1 is a block diagram illustrating the configuration of a coding apparatus according to the embodiment of the present invention.

Preferred embodiments of this invention will be described with reference to the accompanying drawings:

(1) Aspects of the First Implementation (1-1) The Whole Construction of Coding Apparatus In FIG. 1, 1 shows, as a whole, a coding apparatus to which the present invention has been applied, which is roughly composed of a coder 2 and a code book changing part 3. The code book changing part 3 has a signal identifying circuit 4 which identifies the type of input signal S1 being voice signal or music signal. In this case, the signal identifying circuit 4 obtains a predetermined identification parameter from the input signal and performs a predetermined operation processing on this parameter, and identifies whether the input signal is voice signal or music signal based on the operated result. The signal identifying circuit 4 then sends change control signal S2 corresponding to the identified result to a changing switch 5 so as to change the connection of the changing switch 5. Thereby, a code book 6 or a code book 7 which corresponds to the identified result is connected to the coder 2. As another embodiment, it can be thought that one codec out of some codecs is switched on by the result of this identification.

In addition, the first and second code books 6, 7 are memories in which a plurality of typical vectors each having a vector number are stored. In this case, the typical vectors characteristically suitable for voice signal are stored in the first code book 6. The typical vectors characteristically suitable for music signal are stored in the second code book 7.

The coder 2 is a circuit for performing vector quantization on the input signal S1. The coder 2 forms M-th vector from a combination of information data having a predetermined number (M samples) being spectrum amplitude data and various parameter data which are obtained from the input signal S1. The coder 2 then retrieves the typical vector most similar to the M-th vector (i.e., the typical vector that the distance is nearest in the M-dimensional space.) from the first code book 6 or the second code book 7 which is connected, and codes the vector number indicating the typical vector obtained from the retrieved result and outputs it.

In this way, in the coding apparatus 1, the first and second code books are changeable in accordance with the type of input signal, so that performing the appropriate coding processing which corresponds to the type of input signal, the coding processing of high grade can be performed.

In connection, the coded data S3 output from the coding apparatus 1 is supplied to a transmitting circuit (not shown) for example, and after a predetermined transmission processing is performed on the data in the transmitting circuit, the data is sent to a receiving apparatus having a decoding apparatus. In addition, the decoding apparatus provided in the receiving apparatus also has the same first and second code books as that of the coding apparatus 1 so as to decode the coded data S3 by reading out the corresponding typical vector from the first or second code book based on the coded data S3.

(1-2) Signal Identifying Circuit (1-2-1) The Principle of Signal Identification

The principle of signal identifying method in a signal identifying circuit 4 will be explained in this paragraph. When generally comparing voice signal and music signal, the voice signal is characterized by large amplitude change in a short period, and has the characteristics in energy. The voice signal further has strong periodicity because it's sound source is intermittence of respiration pressure produced by the vibration of the human's vocal cords. In addition, the periodicity is generally called "pitch", which is defined as the standard period that sound has (which is the opposite value of the standard frequency).

The voice signal has the characteristics in energy and has a strong pitch component. If taking notice of these characteristics, it can be considered that the voice signal is identified. Therefore, the signal identifying circuit 4 uses these characteristics that the voice signal has so as to identify whether the input signal S1 is voice signal or music signal.

To identify a signal, the signal identifying circuit 4 firstly calculates energy component for each frame, defining that one frame is 160 samples of the input signal S1. On the other hand, the signal identifying circuit 4 generates LPC residual signal from the input signal S1 and extracts the pitch component on the basis of the LPC residual signal. The signal identifying circuit 4 then performs a predetermined operation on thus obtained energy component and pitch component, to identify whether the input signal S1 is voice signal or music signal based on the operated result.

This processing is explained below successively. However, in the explanation described below, the input signal S1 is referred to as input signal S[n] and the LPC residual signal generated from the input signal S1 is referred to as LPC residual signal r[n].

To obtain energy component, the signal identifying circuit 4 accumulates energy for each sample as shown in the following expression:

$$P = \sum_{n=0}^{159} S[n]^2 \tag{1}$$

to calculate frame energy P the frame has, defining that 160 samples of the input signal S[n] is one frame. In connection, if it may be no sound since the frame energy P does not have enough value, the frame is excluded from a target to be evaluated.

Next, the signal identifying circuit 4 calculates average frame energy Pav from the obtained frame energy P. In this case, the signal identifying circuit 4 performs an operation shown in the following expression:

$$Pav = \sum_{t=0}^{3} P\{t\}/4 \tag{2}$$

on the frame energy P of past four frames including a frame notified currently, so as to calculate the average frame energy Pav.

Next, the signal identifying circuit 4 uses the frame energy Pav thus obtained to calculate the changed amount of the frame energy P of a frame currently notified. More specifically, as shown in the following expression:

$$Pd[frm]=|P-Pav|/Pav \tag{3}$$

the average frame energy Pav is subtracted from the frame energy P to calculate the differential frame energy Pd [frm] of the average frame energy Pav.

The signal identifying circuit 4 successively repeats such processing for each frame to obtain the differential frame energy Pd [frm] for 250 frames (approximately, five seconds). In addition, in this embodiment, the differential frame energy Pd [frm] is regarded as energy component.

Further, the signal identifying circuit 4 extracts the pitch component in parallel with this processing. In this case, the signal identifying circuit 4 firstly performs inverse filtering processing on the input signal S[n] to generate the LPC residual signal r[n]. More specifically, the input signal S[n] is linear-predictive (LPC) analyzed to calculate LPC coefficient. The LPC coefficient is used to predictive compose the input signal. By obtaining the difference between the predictive composed input signal and the actual input signal S[n], the LPC residual signal r[n] is generated.

The signal identifying circuit 4 extracts pitch component based on thus obtained LPC residual signal r[n]. To obtain pitch component, the pitch component is not extracted for each frame described above, but is extracted for each sub-frame by separating one frame into four sub-frames (40 samples). However, also in this case, if it may be no sound since frame energy does not exist, the frame is excluded from a target to be evaluated.

To extract the pitch component, when pitch L=20, as shown in the following expressions:

$$Rj = \sum_{n=0}^{39} r[n]r\left[n - \left\lfloor \frac{n+L}{L} \right\rfloor \cdot L\right] \tag{4}$$

where, ⌊X⌋ is the largest integer under X.

$$Sj = \sum_{n=0}^{39} \left\{r\left[n - \left\lfloor \frac{n+L}{L} \right\rfloor \cdot L\right]\right\}^2 \tag{5}$$

where, ⌊X⌋ is the largest integer under X.

$$WL=Rj^2/Sj \tag{6}$$

reciprocal correlation Rj and self-correlation Sj are calculated from the LPC residual signal r[n], thereafter, the pitch data WL is calculated using the reciprocal correlation Rj and the self-correlation Sj. Counting up successively the value of pitch L within the range of L=21 to 148, the operations of the expressions (4) to (6) are executed similarly, so that the pitch data WL of the pitch L=20 to 148 are successively calculated. In addition, in this calculation process, a value of Rj>0 is selected as reciprocal correlation Rj.

Next, the largest pitch data W is extracted among from pitch data WL of thus obtained pitch L=20 to 148. Pitch strength Cos [sfrm] is calculated by performing an operation shown in the following expression:

$$\mathrm{Cos}[sfrm]=W/Tj \tag{7}$$

on the largest pitch data W. In addition, a variable Tj in the expression (7) is self-correlation, and is calculated by the following expression:

$$Tj = \sum_{n=0}^{39} r[n]^2 \tag{8}$$

Such operation is successively repeated for each sub-frame to obtain the pitch strength Cos [sfrm] from 1000 sub-frames (which corresponds to 250 frames). In addition, in this embodiment, this pitch strength Cos [sfrm] is referred to as pitch parameter indicating pitch component.

Next, the signal identifying circuit 4 performs a predetermined operation on the obtained differential frame energy Pd [frm] and the pitch strength Cos [sfrm] and identifies whether the input signal S[n] is voice signal or music signal. More specifically, the signal identifying circuit 4 uses respective data and performs the operation shown in the following expressions:

$$Pd(av) = \sum_{frm=0}^{249} Pd[frm]/250 \tag{9}$$

$$Pd(va) = \sqrt{\sum_{frm=0}^{249} \{Pd[frm] - Pd(av)\}^2 / 250} \quad (10)$$

$$\mathrm{Cos}(av) = \sum_{sfrm=0}^{999} \mathrm{Cos}[sfrm] / 1000 \quad (11)$$

$$\mathrm{Cos}(va) = \sum_{sfrm=0}^{999} \{\mathrm{Cos}[sfrm] - \mathrm{Cos}(av)\}^2 / 1000 \quad (12)$$

to calculate the average value Pd(av) and the variance value Pd(va) of the differential frame energy Pd [frm], and at the same time, calculates the average value Cos(av) and variance value Cos(va) of the pitch strength Cos [sfrm]. However, as apparent from the expression (10), the variance value of the differential frame energy Pd [frm] is actually the standard deviation which is a square root of the variance value.

Next, the signal identifying circuit 4 evaluates whether thus obtained average value Cos(av) and variance value Cos(va) of the pitch strength Cos [sfrm] satisfy which of expressions of inequality shown in the following expressions:

$$\mathrm{Cos}(va) \geqq 0.175\ \mathrm{Cos}(av) - 0.0225 \quad (13)$$

$$0.125\ \mathrm{Cos}(av) - 0.0175 < \mathrm{Cos}(va) < 0.175\ \mathrm{Cos}(av) - 0.0225 \quad (14)$$

$$\mathrm{Cos}(va) \leqq 0.125\ \mathrm{Cos}(av) - 0.0175 \quad (15)$$

As a result, if they satisfy the expression (13), the input signal S[n] is judged as voice signal, and if they satisfy the expression (15), the input signal S[n] is judged as music signal. On the contrary, if they satisfy the expression (14), the input signal S[n] is not judged here since it exists on gray zone, and the type of signal is judged by the evaluation described next.

When the values satisfy the expression (14) and the input signal exists on the gray zone, the signal identifying circuit 4 evaluates whether the average value Pd(av) and variance value Pd(va) of the differential frame energy Pd [frm] satisfy either of expressions of inequality shown in the following expressions:

$$Pd(va) \geqq -0.5\ Pd(av) + 0.8 \quad (16)$$

$$Pd(va) < -0.5\ Pd(av) + 0.8 \quad (17)$$

As a result, if they satisfy the expression (16), the input signal S[n] is judged as voice signal, and if they satisfy the expression (17), the input signal S[n] is judged as music signal.

In this way, the signal identifying circuit 4 identifies the type of input signal S[n] by evaluating that the average value Cos(av) and variance value Cos(va) of the pitch strength Cos [sfrm] calculated satisfy which of expressions of inequality. As a result of the evaluation, if the input signal can not be identified since it exists on gray zone, by evaluating that the average value Pd(av) and variance value Pd(va) of the differential frame energy Pd [frm] satisfy either of expressions of inequality, the type of the input signal S[n] is identified. Such 2-step identification makes it possible to certainly identify the type of input signal S[n] in the signal identifying circuit 4.

Figure 2:
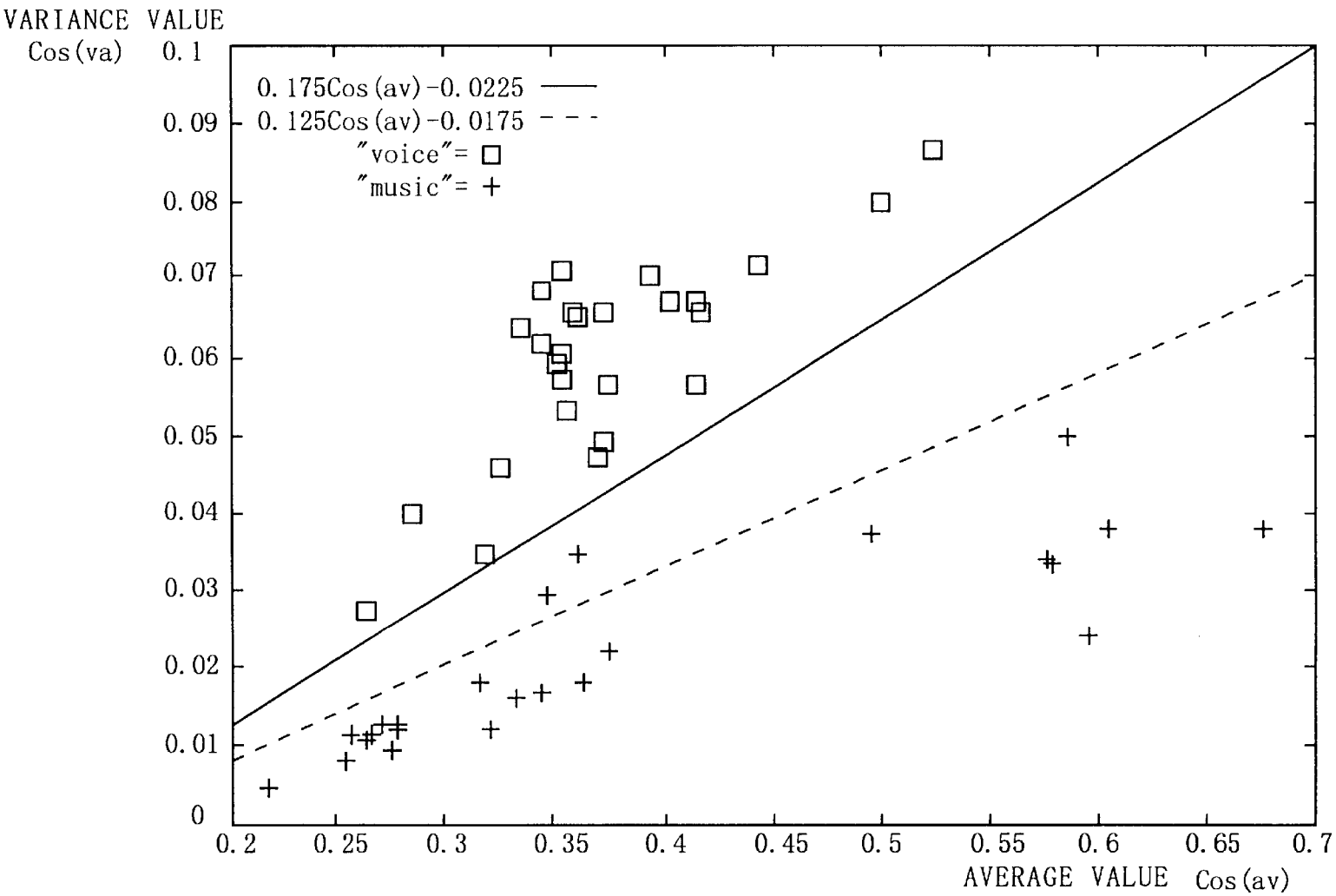
FIG. 2 is a pitch strength characteristic diagram showing a relation between the average value and the variance value of the pitch strength Cos [sfrm]

Here, FIG. 2 shows the relation between the average value Cos(av) and variance value Cos(va) of the pitch strength Cos [sfrm] at the time of inputting various voice signal and music signal as the input signal S[n]. As apparent from FIG. 2, the voice signal tends to have larger variance value Cos(va) of the pitch strength than that of the music signal. The judgement based on the variance value Cos(va) of the pitch strength makes it possible to identify whether the input signal is voice signal or music signal.

In connection, the area above a solid line shown in FIG. 2 represents the expression of inequality for judgement of the expression (13) described above. The area below a broken line represents the expression of inequality for judgement of the expression (15). So, as apparent from FIG. 2, if satisfying the expression (13), the input signal S[n] can be judged as voice signal, and if satisfying the expression (15), the input signal S[n] can be judged as music signal.

Figure 3:
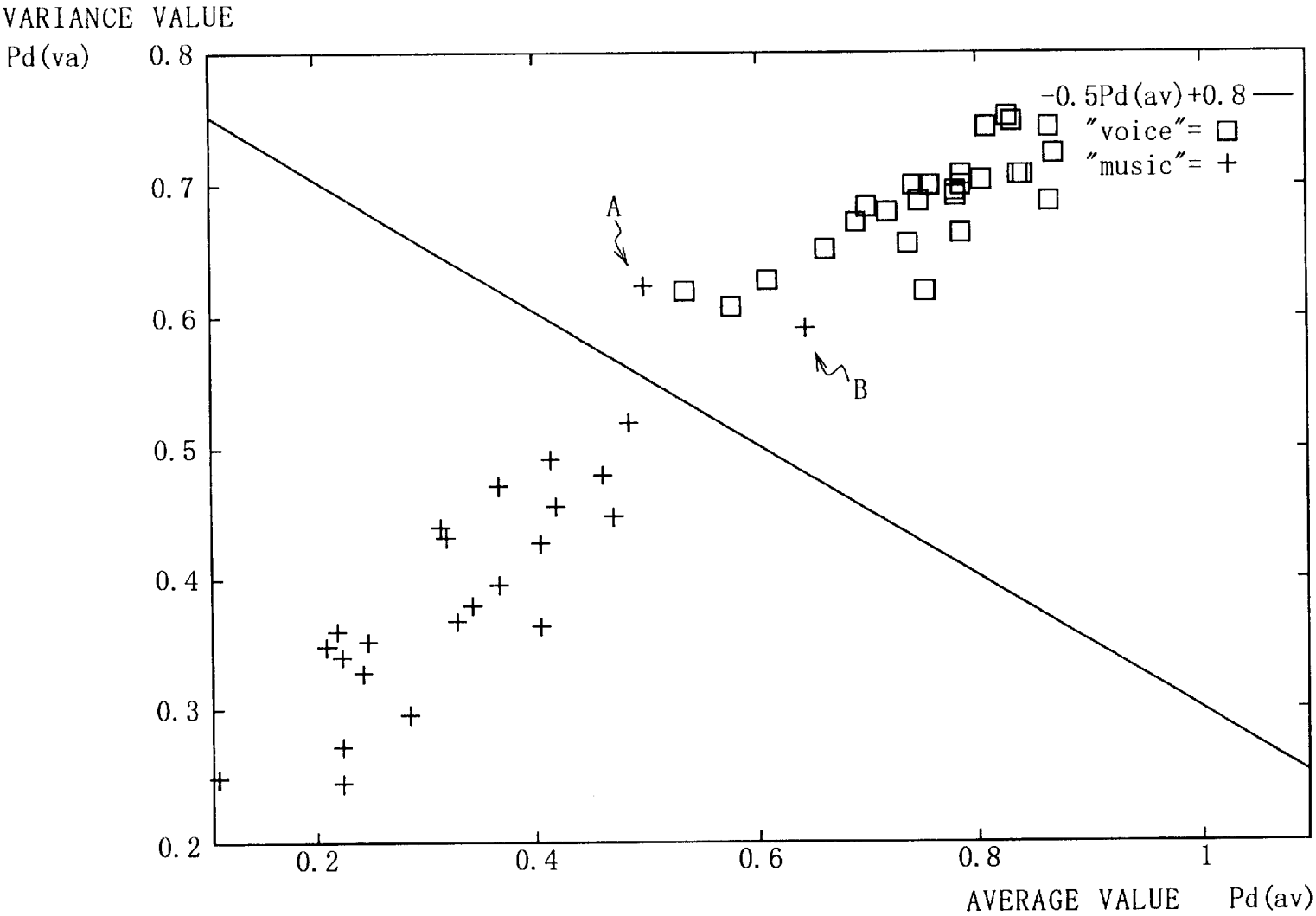
FIG. 3 is a differential frame energy characteristic diagram showing a relation between the average value and the variance value of the differential frame energy Pd [frm]

Next, FIG. 3 shows the relation between the average value Pd(av) and variance value Pd(va) of the differential frame energy Pd [frm] at the time of inputting various voice signal and music signal as the input signal S[n]. As apparent from FIG. 3, the voice signal tends to have larger variance value Pd(va) of the differential frame energy than that of the music signal. The judgement based on the variance value Pd(va) of the differential frame energy makes it possible to identify whether the input signal is voice signal or music signal.

In connection, the area above a solid line shown in FIG. 3 represents the expression of inequality for judgement of the expression (16) described above. The area below the solid line represents the expression of inequality for judgement of the expression (17). So, if satisfying the expression (16), the input signal S[n] can be judged as voice signal, and if satisfying the expression (17), the input signal S[n] can be judged as music signal. In addition, strictly speaking, as shown in points A and B of FIG. 3, since the music signal may satisfies the expression of inequality of the expression (16), the judgement by only differential frame energy may cause an error judgement. However, the signal identifying circuit 4 also performs the judgement by pitch strength, in addition to the judgement by differential frame energy. The 2-step judgement makes it possible to prevent the judgement that the point A or B is voice signal.

(1-2-2) The Construction of Signal Identifying Circuit

Figure 4:
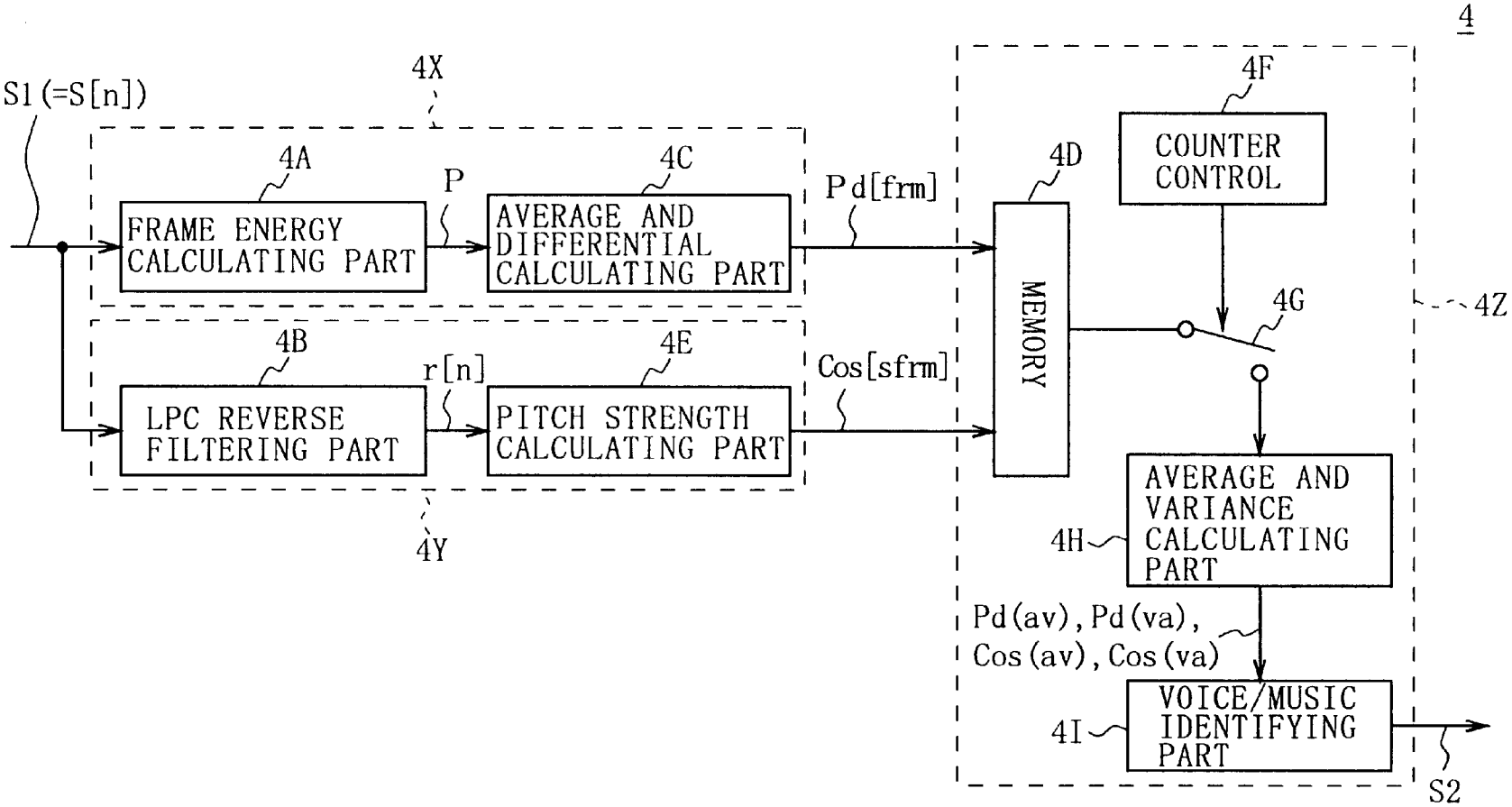
FIG. 4 is a block diagram illustrating the configuration of the signal identifying circuit.

The concrete construction of the signal identifying circuit 4 will be explained in this paragraph. The signal identifying circuit 4 identifies the type of the input signal S[n] based on the principle of identification described above. As shown in FIG. 4, the signal identifying circuit 4 is roughly composed of three parts: energy calculating part 4X for calculating energy component that the input signal S1 (=S[n]) has; pitch extracting part 4Y for extracting pitch component that the input signal S1 has; and identifying part 4Z for performing a predetermined operation on the energy component and the pitch component and for identifying whether the input signal S1 is voice signal or music signal based on the operated result.

In the signal identifying circuit 4, the input signal S1 (=S[n]) is firstly input to a frame energy calculating part 4A of the energy calculating part 4X and a LPC reverse filtering part 4B of the pitch extracting part 4Y. The frame energy calculating part 4A successively executes the operation of the above-mentioned expression (1), defining 160 samples of the input signal S1 as one frame, so as to calculate frame energy P from the input signal S1, and outputs this to the average and differential calculating part 4C of a later stage.

The average and differential calculating part 4C has a buffer for storing frame energy P for at least four frames inside, and stores the frame energy P supplied from the frame energy calculating part 4A in the buffer successively. The average and differential calculating part 4C executes the operation of the expression (2) by using the frame energy P for past four frames including frame energy P which is newly input so as to calculate average frame energy Pav. At the same time, the average and differential calculating part 4C executes the operation of the expression (3) by subtracting the average frame energy Pav from the frame energy P which is newly input so as to calculate differential frame energy Pd [frm]. The average and differential calculating part 4Csuccessively executes the operation processing on the frame energy P which is input, so as to obtain the differential frame energy Pd [frm] of each frame and output this to a memory 4D which is a part of the identifying part 4Z of a later stage. In connection, when the input frame energy P is zero, the average and differential calculating part 4C does not execute this processing of calculating differential frame energy and regards the frame as being out of a target to be evaluated.

On the other hand, the LPC reverse filtering part 4B of the pitch extracting part 4Y performs the reverse filtering processing described above on the input signal S1, to generate LPC residual signal r[n] from the input signal S1 and output this to the pitch strength calculating part 4E of a later stage.

The pitch strength calculating part 4E divides one frame into four sub-frames and extracts the pitch strength for each sub-frame. More specifically, the pitch strength calculating part 4E executes the above-mentioned operations of the expressions (4) to (6) to retrieve pitch data WL among from the sub-frame, and extracts the largest pitch data W among from the pitch data WL. The above-mentioned operations of the expressions (7) and (8) are executed on the pitch data W, so as to calculate the pitch strength Cos [sfrm]. The pitch strength calculating part 4E executes this processing for each sub-frame to extract the pitch strength Cos [sfrm] from each sub-frame, and successively outputs this to the memory 4D which is a part of the identifying part 4Z of a later stage.

The memory 4D of the identifying part 4Z is a storing circuit for storing the differential frame energy Pd [frm] and the pitch strength Cos [sfrm], and stores the differential frame energy Pd [frm] successively supplied from the average and differential calculating part 4C and the pitch strength Cos [sfrm] successively supplied from the pitch strength calculating part 4E in the internal memory area.

The counter controlling part 4F is a counter for counting the number of the differential frame energy Pd [frm] and the pitch strength Cos [sfrm] which are input to the memory 4D by counting frame number frm and sub-frame number sfrm. When the differential frame energy Pd [frm] for 250 frames and the pitch strength Cos [sfrm] for 1000 sub-frames are stored in the memory 4D, the counter controlling part 4F turns a connection switch 4G on.

When the operation of the counter controlling part 4F turns the connection switch 4G on, the average and variance value calculating part 4H respectively reads out the differential frame energy Pd [frm] and the pitch strength Cos [sfrm] from the memory 4D, and executes the operations of the expressions (9) to (12), so as to calculate the average value Pd(av) and variance value Pd(va) of the differential frame energy Pd [frm] and the average value Cos(av) and variance value Cos(va) of the pitch strength Cos [sfrm] which are output to a voice/music identifying part 4I of a later stage.

The voice/music identifying part 4I determines whether the input signal S1 is voice signal or music signal, by judging that which of expressions of inequality (13) to (15) the average value Cos(av) and variance value Cos(va) of the pitch strength Cos [sfrm] satisfy. At this time, if the average value Cos(av) and variance value Cos(va) satisfy the expression (14) so that a signal can not be identified, the voice/music identifying part 4I determines whether the input signal S1 is voice signal or music signal, by judging that either of expressions of inequality (16) to (17) the average value Pd(av) and variance value Pd(va) of the differential frame energy Pd [frm] satisfy. The voice/music identifying part 4I outputs change control signal S2 according to the determined result to a changing switch 5 to connect the code book 6 or 7 according to the determined result to the coder 2.

(1-3) Operations and Effects

In the above construction, in the coding apparatus 1, the input signal S1 is input to the signal identifying circuit 4 where the type of the input signal S1 is identified, and the code book 6 or 7 suitable for the characteristics of the input signal S1 is connected to the coder 2. Thereby, the coding apparatus 1 is not necessary to identify the input signal S1 by a user as a conventional apparatus, and automatically identifies the type of the input signal S1 to connect the code book 6 or 7 suitable for the input signal S1 to the coder 2. It is possible to perform a coding processing of high grade without trouble for a user.

Figure 5:
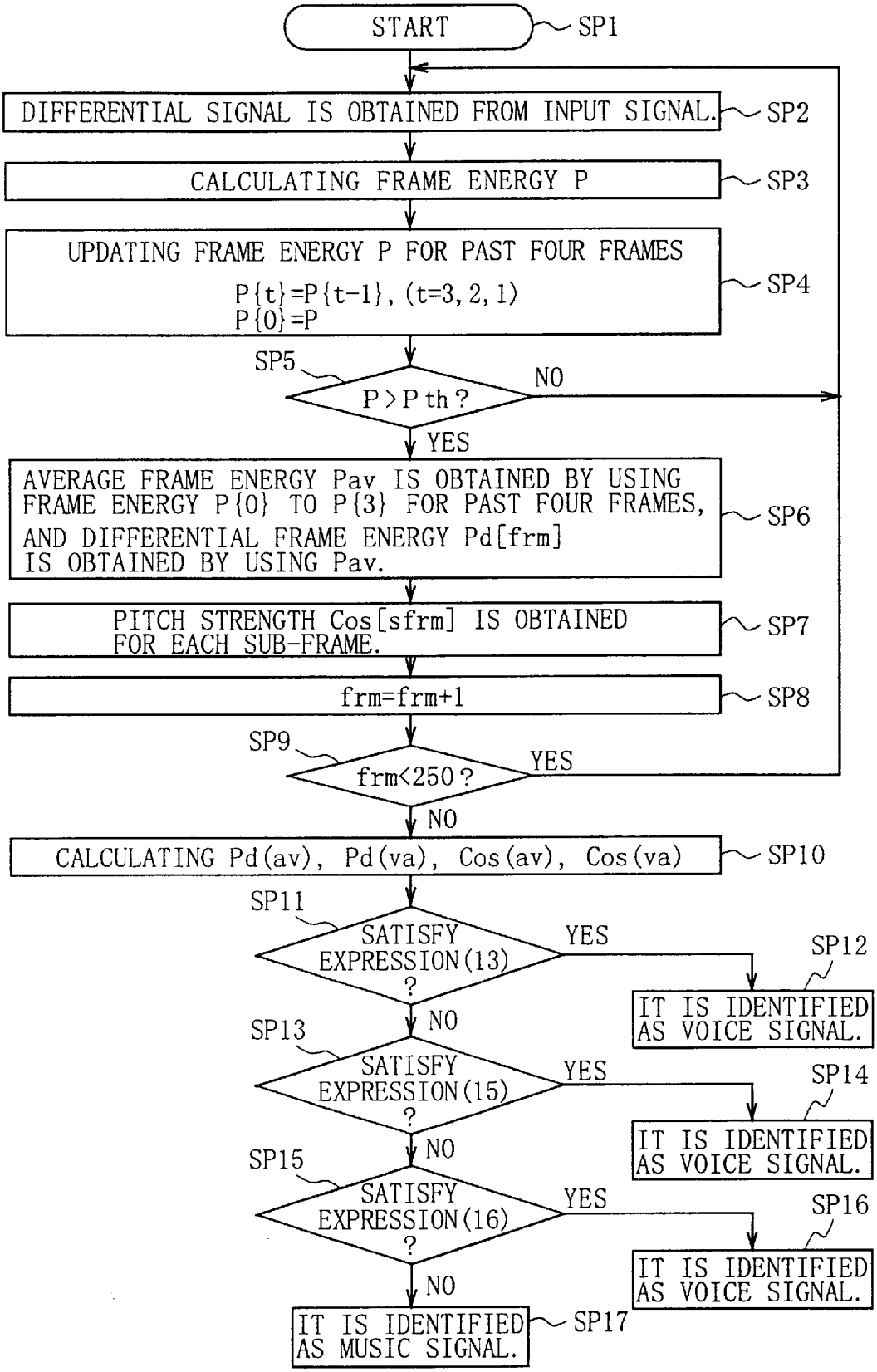
FIG. 5 is a flowchart showing the signal identifying method of the signal identifying circuit.

Here, the method of identifying signal in the signal identifying circuit 4 will be explained referring to the flowchart of FIG. 5. In the signal identifying circuit 4, entering from step SP1, the frame number frm and the sub-frame number sfrm are set to zero, and the contents of the buffer for storing the frame energy P is also set to zero, and then a processing proceeds to next step SP2.

At step SP2, the signal identifying circuit 4 performs a LPC reverse filtering processing on the input signal S1 (=S[n]) to generate the LPC residual signal r[n]. At next step SP3, the signal identifying circuit 4 executes an operation processing of the expression (1) on the input signal S[n] to calculate the frame energy P.

At next step SP4, the signal identifying circuit 4 stores the frame energy P calculated at step SP3 in the buffer as a frame energy P{0}, and stores the frame energy P{1}, P{2}, P{3} which have been stored before as P{0}, P{1}, P{2}. At next step SP5, the signal identifying circuit 4 judges whether the value of the frame energy P which has been stored as the frame energy P{0} is larger than the predetermined threshold value Pth or not. If the value is larger than the threshold value Pth, a processing proceeds to the next step SP6, and if the value is smaller than the threshold value Pth, regards it as being out of a target to be evaluated and returns to step SP2.

At step SP6, the signal identifying circuit 4 executes the operation processing of the expression (2) by using the frame energy P{0} to P{3} for past four frames to calculate the average frame energy Pav, and executes the operation processing of the expression (3) by using the average frame energy Pav obtained to calculate the differential frame energy Pd [frm] of the frame energy P which is stored as a frame energy P{0}. The signal identifying circuit 4 then stores the differential frame energy Pd [frm] obtained in the memory 4D.

At next step SP7, the signal identifying circuit 4 obtains the pitch strength Cos [sfrm] for each sub-frame from the LPC residual signal r[n] of the frame whose differential frame energy Pd [frm] is obtained. In this case, since a sub-frame is obtained from one frame which is divided into four, the pitch strength Cos [sfrm] is calculated from four sub-frames at this step SP7. The signal identifying circuit 4 then stores the obtained pitch strength Cos [sfrm] in the memory 4D similarly to the differential frame energy Pd [frm]. In addition, the signal identifying circuit 4 increments the sub-frame number sfrm whenever the pitch strength Cos [sfrm] is obtained from the sub-frame.

At next step SP8, the signal identifying circuit 4 increments the value of frame number frm, and at next step SP9, determines whether the value is smaller than "250" or not. As a result, if an affirmative result is obtained, a processing returns to step SP2 where the same processing is repeated. If a negative result is obtained, a processing proceeds to the next step SP10.

At step SP10, the signal identifying circuit 4 executes the operation processing of the expressions (9) and (10) to obtain the average value Pd(av) and the variance value Pd(va) from the differential frame energy Pd [frm] obtained from 250 frames, and executes the operation processing of the expressions (11) and (12) to obtain the average value Cos(av) and the variance value Cos(va) from the pitch strength Cos [sfrm] obtained from 1000 sub-frames.

At next step SP11, the signal identifying circuit 4 judges whether the average value Cos(av) and the variance value Cos(va) of the pitch strength Cos [sfrm] satisfy the expression of inequality of the expression (13) or not. If they satisfy the expression (13), a processing proceeds to step SP12 where the input signal S1 is determined as voice signal, and if they do not satisfy the expression (13), proceeds to the next step SP13.

At next step SP13, the signal identifying circuit 4 judges whether the average value Cos(av) and the variance value Cos(va) of the pitch strength Cos [sfrm] satisfy the expression of inequality of the expression (15) or not. If they satisfy the expression (15), a processing proceeds to step SP14 where the input signal S1 is determined as voice signal, and if they do not satisfy the expression (15), proceeds to the next step SP15.

At next step SP15, the signal identifying circuit 4 judges whether the average value Pd(av) and the variance value Pd(va) of the differential frame energy Pd [frm] satisfy the expression of inequality of the expression (16) or not. If they satisfy the expression (16), a processing proceeds to step SP16 where the input signal S1 is determined as voice signal, and if they do not satisfy the expression (16), proceeds to the step SP17 where the input signal S1 is determined as music signal.

In this way, the signal identifying circuit 4 obtains the differential frame energy Pd [frm] from each frame of the input signal S1 (=S[n]), and obtains the pitch strength Cos [sfrm] from each sub-frame of the LPC residual signal r[n] generated by processing the input signal S1. The signal identifying circuit 4 then stores the differential frame energy Pd [frm] and the pitch strength Cos [sfrm] for a predetermined frames, and based on this, obtains the average value Pd(av), Cos(av) and the variance value Pd(va), Cos(va) of the differential frame energy Pd [frm] and the pitch strength Cos [sfrm]. The signal identifying circuit 4 identifies whether the input signal S1 is voice signal or music signal based on the average value Cos(av) and the variance value Cos(va) of the pitch strength Cos [sfrm]. If this judgement is not enough to determine, the signal identifying circuit 4 identifies whether the input signal S1 is voice signal or music signal based on the average value Pd(av) and the variance value Pd(va) of the differential frame energy Pd [frm].

Thus, the identification according to the pitch strength Cos [sfrm] and the identification according to the differential frame energy Pd [frm] are combined to perform the two-step identification processing, so that the signal identifying circuit 4 can surely identify the type of the input signal S1. In accordance with the result identified by the signal identifying circuit 4, the code book 6 or 7 is changed, so that the coding apparatus 1 can use the optimum code book 6 or 7 in accordance with the input signal S1 to be coded. The high grade coding processing can be realized without requesting a complicated changing work to a user.

With the above construction, the differential frame energy Pd [frm] and the pitch strength Cos [sfrm] are obtained from the input signal S1 (=S[n]), the identification parameters are stored for a predetermined frames to obtain the average value Pd(av), Cos(av) and the variance value Pd(va), Cos (va) of the differential frame energy Pd [frm] and the pitch strength Cos [sfrm], and then. the type of the input signal S1 is identified based on the average value Pd(av), Cos(av) and the variance value Pd(va), Cos(va). Thereby, the type of the input signal S1 can be surely and easily identified. Further, the code book 6 or 7 is changed in accordance with the identified result, so that without user's complicated changing work, the optimum code books 6 or 7 in accordance with the input signal S1 is used to perform a high grade coding processing.

(2) Aspects of the Second Implementation

The above first embodiment has been described with the case where the reciprocal correlation Rj and the self-correlation Sj are used to obtain pitch data WL, and the largest pitch data W of the pitch data WL is divided by the self-correlation Tj to obtain the pitch strength Cos [sfrm] which is used as a pitch parameter. However, the second embodiment obtains a pitch parameter by a method which will be explained below.

In the signal identifying circuit according to this embodiment, the LPC residual signal r[n] for 256 samples is multiplied by time window function (e.g., Humming window), to generate newly LPC residual signal rh[n]. Then, to thus obtained LPC residual signal rh[n], an operation processing of the following expression is executed:

$$Pr1 = \sum_{n=0}^{255-L} rh[n]rh[n+L] \tag{18}$$

to obtain the reciprocal correlation Pr1, when the pitch L=20. Next, the pitch value L is successively counted up within the range of L=21 to 148, and the same operation of the expression (18) is executed to obtain the reciprocal correlation Pr1 for the pitch L=20 to 148. The largest reciprocal correlation Pr is extracted from the reciprocal correlation Pr1 of thus obtained pitch L=20 to 148, and executes the operation of the following expression:

$$r0r[frm]=Pr/Pr0 \tag{19}$$

for the largest reciprocal correlation Pr, to obtain the pitch strength r0r [frm] which is used as a pitch parameter. In addition, the variable Pr0 in the expression (19) is the self-correlation, and is obtained by the following expression:

$$Pr0 = \sum_{n=0}^{255} rh[n]^2 \tag{20}$$

Such operation is successively executed on the LPC residual signal r[n], so as to successively obtain the pitch strength r0r [frm] in the signal identifying circuit according to this embodiment. When the pitch strength r0r [frm] is stored for 250 frames for example, the signal identifying circuit executes the operation of the following expressions:

$$r0r(av) = \sum_{frm=0}^{249} r0r[frm]/250 \tag{21}$$

$$r0r(va) = \sqrt{\sum_{frm=0}^{249} \{r0r[frm] - r0r(av)\}^2/250} \tag{22}$$

to obtain the average value r0r(av) and the variance value r0r(va) of the pitch strength r0r [frm]. However, as apparent from this expression (22), strictly speaking, the variance value is actually the standard deviation which is a square root of the variance value.

Next, the signal identifying circuit evaluates from the following expressions:

$$r0r(va) \geqq 0.153r0r(av)+0.113 \tag{23}$$

$$0.07r0r(av)+0.137 < r0r(va) < 0.153r0r(av)+0.113 \tag{24}$$

$$r0r(va) \leqq 0.07r0r(av)+0.137 \tag{25}$$

that which of expressions of inequality thus obtained average value r0r(av) and the variance value r0r(va) of the pitch strength r0r [frm] satisfy. As a result, if they satisfy the expression (23), the input signal S[n] is determined as voice signal, and if they satisfy the expression (25), the input signal S[n] is determined as music signal. On the contrary, if they satisfy the expression (24), the input signal S[n] is not judged here since it exists on gray zone, and similarly to the first embodiment, the type of the input signal S[n] is identified by a judgement processing using the average value Pd(av) and the variance value Pd(va) of the differential frame energy Pd [frm].

In this way, in the signal identifying apparatus according to this embodiment, the LPC residual signal r[n] is multiplied by the time window function to generate new LPC residual signal rh[n], and the reciprocal correlation Pr1 which relates to pitch L is obtained from this LPC residual signal rh[n]. The largest reciprocal correlation Pr of the reciprocal correlation Pr1 is divided by self-correlation Pr0 so as to obtain the pitch strength r0r [frm]. The average value r0r(av) and the variance value r0r(va) of the pitch strength r0r [frm] are analyzed to identify whether the input signal S[n] is voice signal or music signal.

Figure 6:
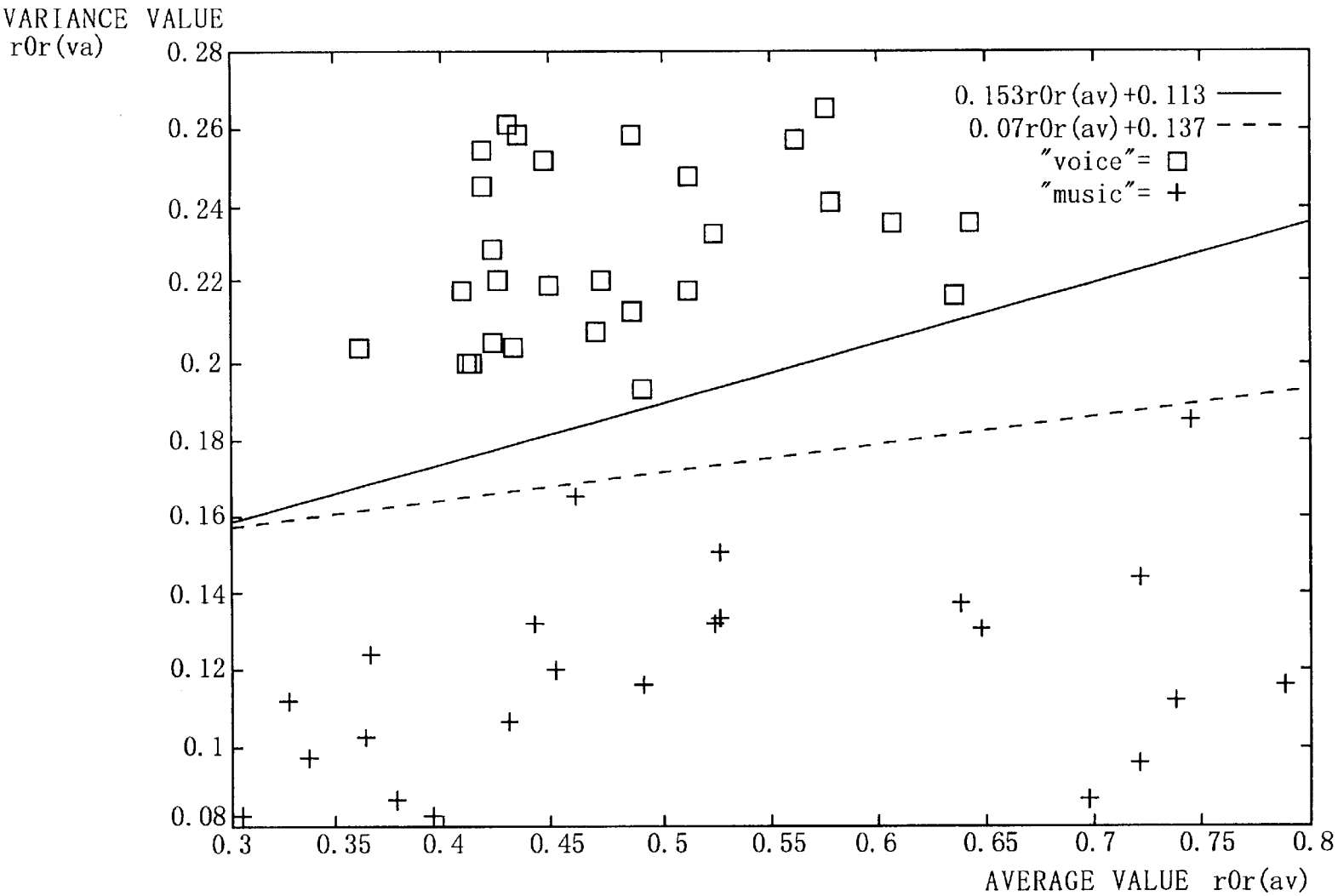
FIG. 6 is a pitch strength characteristic diagram showing a relation between the average value and the variance value of the pitch strength r0r [frm].

Here, FIG. 6 shows the relation between the average value r0r(av) and the variance value r0r(va) of the pitch strength r0r [frm] at the time of inputting various voice signal or music signal as an input signal S[n] actually. As apparent from FIG. 6, the voice signal tends to have larger variance value r0r(va) of the pitch strength r0r [frm] than that of the music signal. The judgement based on the variance value r0r(va) of the pitch strength makes it possible to identify whether the input signal is voice signal or music signal.

In connection, the area above a solid line shown in FIG. 6 represents the expression of inequality for judgement of the expression (23) described above. The area below a broken line represents the expression of inequality for judgement of the expression (25). So, as apparent from FIG. 6, if satisfying the expression (23), the input signal S[n] can be judged as voice signal, and if satisfying the expression (25), the input signal S[n] can be judged as music signal.

According to the above construction, the LPC residual signal r[n] is multiplied by the time window function to generate new LPC residual signal rh[n], and the reciprocal correlation Pr1 which relates to pitch L is obtained from this LPC residual signal rh[n]. The largest reciprocal correlation Pr of the reciprocal correlation Pr1 is divided by self-correlation Pr0 so as to obtain the pitch strength r0r [frm]. The average value r0r(av) and the variance value r0r(va) of the pitch strength r0r [frm] are analyzed to identify whether the input signal S[n] is voice signal or music signal. Thereby, the type of the input signal S[n] can be identified more accurately.

(3) Aspects of Other Implementations

The embodiment described above has dealt with the case where one frame is defined as 160 samples to obtain frame energy P. However, this invention is not limited to this, but can also obtain the frame energy P by defining one frame as other number of samples. That is, the frame energy is obtained as energy component from the frame which has a predetermined number of samples, so that the same effect as described above can be obtained.

Further, the embodiment described above has dealt with the case where the average frame energy Pav is obtained from the average value of the frame energy P for four frames. However, this invention is not limited to this, but the number of frames can be changed to other number of frames in order to obtain the average frame energy. That is, a predetermined number of frame energy is used to obtain the short period average value of the energy component, so that the same effect as described above can be obtained.

Further, the embodiment described above has dealt with the case where the operation of the expression (3) is executed using the frame energy P and the average frame energy Pav to obtain the differential frame energy Pd [frm]. However, this invention is not limited to this, but the differential frame energy can be obtained by simply subtracting the average frame energy from the frame energy. That is, the changed amount from the short average value is calculated by obtaining the short period average value of the energy component and subtracting this average value from the energy component, so that the same effect as described above can be obtained.

Further, the embodiment described above has dealt with the case where the differential frame energy Pd [frm] for 250 frames is used to obtain the average value Pd(av) and the variance value Pd(va). However, this invention is not limited to this, but the other number of frames can be used as the number of frames in order to obtain the average value and the variance value of the differential frame energy. That is, a predetermined number of differential frame energy is used to obtain the average value and the variance value, so that the same effect as described above can be obtained.

Further, the embodiment described above has dealt with the case where the pitch strength Cos [sfrm] for 1,000 sub-frames is used to obtain the average value Cos(av) and the variance value Cos(va). However, this invention is not limited to this, but the other number of sub-frames can be used as the number of sub-frames in order to obtain the average value and the variance value of the pitch strength. That is, a predetermined number of pitch strength Cos [sfrm] is used to obtain the average value and the variance value, so that the same effect as described above can be obtained.

Further, the second embodiment described above has dealt with the case where the pitch strength r0r [frm] for 250 frames is used to obtain the average value r0r(av) and the variance value r0r(va). However, this invention is not limited to this, but the other number of frames can be used as the number of frames in order to obtain the average value and the variance value of the pitch strength. That is, a predetermined number of pitch strength r0r [frm] is used to obtain the average value and the variance value, so that the same effect as described above can be obtained.

Further, the embodiment described above has dealt with the case where standard deviation is obtained to be used as the variance value Pd(va) of the differential frame energy Pd [frm]. However, this invention is not limited to this, but the same effect as described above can be obtained also by obtaining the variance value itself.

Further, the second embodiment described above has dealt with the case where standard deviation is obtained to be used as the variance value r0r(va) of the pitch strength r0r [frm]. However, this invention is not limited to this, but the same effect as described above can be obtained also by obtaining the variance value itself.

Further, the embodiment described above has dealt with the case where the changing switch 5 changes the code book 6 or the code book 7 in accordance with the change control signal S2. However, this invention is not limited to this, but is provided with the changing means for changing the first code book suitable for voice signal and the second code book suitable for music signal in accordance with the identified result, so that the same effect as described above can be obtained.

Further, the embodiment described above has dealt with the case where this invention is applied to the coding apparatus 1 for forming M-th vector from a combination of the information data to the number of M, which are composed of spectrum amplitude data or various parameter data obtained from the input signal S1, and for retrieving the typical vector most similar to the M-th vector from the first code book 6 or the second code book 7. However, this invention is not limited to this, but is widely applicable to such coding apparatus that has the code book suitable for voice signal and the code book suitable for music signal, and that codes the input signal referring either of the code books in accordance with the type of the input signal. That is, the type of input signal is identified and the code book suitable for voice signal and the code book suitable for music signal is changed in accordance with the identified result, so that the same effect as described above can be obtained.

As stated above, according to the present invention, the pitch component that input signal has is extracted and the energy component that input signal has is obtained, to execute a predetermined operation to the pitch component and the energy component. Based on the operated result, it is identified that the input signal is voice signal or music signal, so that the type of the input signal can be identified easily.

Further, the pitch component that input signal has is extracted and the energy component that input signal has is obtained, to execute a predetermined operation to the pitch component and the energy component. Based on the operated result, it is identified that the input signal is voice signal or music signal, and the first code book suitable for voice signal and the second code book suitable for music signal are changed in accordance with the identified result. Thereby, the high grade coding processing can be performed by using the appropriate code book suitable for the input signal if a user does not perform the complicated changing processing.

While there has been described in connection with the preferred embodiments of the invention, it will be obvious to those skilled in the art that various changes and modifications may be aimed, therefore, to cover in the appended claims all such changes and modifications as fall within the true spirit and scope of the invention.

What is claimed is:

1. A signal identifying device comprising:

pitch extracting means for extracting a pitch component of an input signal;

energy calculating means for calculating an energy component of said input signal; and identifying means for executing a predetermined operation on said pitch component and on said energy component and for identifying whether said input signal is a voice signal or a music signal based on a result of said predetermined operation, wherein said pitch extracting means extracts a pitch strength as said pitch component, said energy calculating means calculates a frame energy wherein one frame is defined as a predetermined number of samples of said input signal, and calculates a differential frame energy as said energy component by subtracting a predetermined time period average value from said frame energy, and said identifying means calculates an average value and a variance value of said pitch strength and calculates an average value and a variance value of said differential frame energy, so as to identify said input signal based on said average value and said variance value of said pitch strength and said average value and said variance value of said differential frame energy.

2. The signal identifying device according to claim 1, wherein said identifying means identifies said input signal based on said average value and said variance value of said pitch strength and, when said input signal can not be identified by said average value and said variance value of said pitch strength, said identifying means identifies said input signal based on said average value and said variance value of said differential frame energy.

3. The signal device according to claim 2, wherein said identifying means identifies said input signal as a music signal when said variance value of said pitch strength is lower than a first threshold value specified based on said average of said pitch strength, and identifies said input signal as a speech signal when said variance value of said pitch strength is higher than a second threshold value, wherein said second threshold value is higher than said first threshold value, and when said variance value of said pitch strength is between said first and second threshold values said identifying means identifies said input signal as said music signal when said variance value of said differential frame energy is lower than a third threshold value specified based on said average of said differential frame energy, and identifies said input signal as said speech signal when said variance value of said differential frame energy is higher than or equal to said third threshold value.

4. A code book or codec changing device comprising:

pitch extracting means for extracting a pitch component of an input signal;

energy calculating means for calculating an energy component of said input signal;

identifying means for executing a predetermined operation on said pitch component and on said energy component and for identifying whether said input signal is a voice signal or a music signal based on a result of said predetermined operation; and changing means for changing between a first code book or codec characteristically suitable for said voice signal and a second code book or codec characteristically suitable for said music signal in accordance with an identifying result from said identifying means, wherein said pitch extracting means extracts a pitch strength as said pitch component, said energy calculating means calculates a frame energy, wherein one frame is a predetermined number of samples of said input signal, and calculates a differential frame energy as said energy component by subtracting a predetermined time period average value from said frame energy, and said identifying means calculates an average value and a variance value of said pitch strength and calculates an average value and a variance value of said differential frame energy, so as to identify said input signal based on said average value and said variance value of said pitch strength and said average value and said variance value of said differential frame energy.

5. The code book or codec changing device according to claim 4, wherein said identifying means identifies said input signal based on said average value and said variance value of said pitch strength and, when said input signal can not be identified by said average value and said variance value of said pitch strength, said identifying means identifies said input signal based on said average value and said variance value of said differential frame energy.

6. The code book or codec changing device according to claim 5, wherein said identifying means identifies said input signal as a music signal when said variance value of said pitch strength is lower than a first threshold value specified based on said average of the pitch strength, and identifies said input signal as a speech signal when said variance value of said pitch strength is higher than a second threshold value, wherein said second threshold value is higher than said first threshold value, and when said variance value of said pitch strength is between said first and second threshold values said identifying means identifies said input signal as said music signal when said variance value of said differential frame energy is lower than a third threshold value specified based on said average of said differential frame energy, and identifies said input signal as said speech signal when said variance value of said differential frame energy is higher than or equal to said third threshold value.

7. A signal identifying method comprising the steps of:

extracting a pitch component of an input signal and calculating an energy component of said input signal; and executing a predetermined operation on said pitch component and on said energy component and identifying whether said input signal is a voice signal or a music signal based on a result of said predetermined operation, wherein said step of extracting includes extracting a pitch strength as said pitch component, and said step of calculating includes calculating a frame energy, wherein one frame is defined as a predetermined number of samples of said input signal, and calculating a differential frame energy as said energy component by subtracting a predetermined time period average value from said frame energy, and said predetermined operation includes calculating an average value and a variance value of said pitch strength and calculating an average value and a variance value of said differential frame energy, so as to identify said input signal based on said average value and said variance value of said pitch strength and said average value and said variance value of said differential frame energy.

8. The signal identifying method according to claim 7, wherein said step of identifying said input signal employs said average value and said variance value of said pitch strength and, when said input signal can not be identified by said average value and said variance value of said pitch strength, said step of identifying said input signal employs said average value and said variance value of said differential frame energy.

9. The signal identifying method according to claim 8, wherein said step of identifying identifies said input signal as a music signal when said variance value of said pitch strength is lower than a first threshold value specified based on said average of the pitch strength, and identifies said input signal as a speech signal when said variance value of said pitch strength is higher than a second threshold value, wherein said second threshold value is higher than said first threshold value, and when said variance value of said pitch strength is between said first and second threshold values said identifying means identifies said input signal as said music signal when said variance value of said differential frame energy is lower than a third threshold value specified based on said average of said differential frame energy, and identifies said input signal as said speech signal when said variance value of said differential frame energy is higher than or equal to said third threshold value.

10. A code book or codec changing method comprising the steps of:

extracting a pitch component of an input signal and calculating an energy component of said input signal;

executing a predetermined operation on said pitch component and on said energy component and identifying whether said input signal is a voice signal of a music signal based on a result of said predetermined operation; and changing between a first code book or codec characteristically suitable for said voice signal and a second code book or codec characteristically suitable or said music signal in accordance with a result of said step of identifying, wherein said step of extracting includes extracting a pitch strength as said pitch component, and said step of calculating includes calculating a frame energy, wherein one frame is defined as a predetermined number of samples of said input signal, and calculating a differential frame energy as said energy component by subtracting a predetermined time period average value from said frame energy, and said predetermined operation includes calculating an average value and a variance value of said pitch strength and calculating an average value and a variance value of said differential frame energy, so as to identify said input signal based on said average value and said variance value of said pitch strength and said average value and said variance value of said differential frame energy.

11. The code book or codec changing method according to claim 10, wherein said step of identifying said input signal employs said average value and said variance value of said pitch strength and, when said input signal can not be identified by said average value and said variance value of said pitch strength, said step of identifying said input signal employs said average value and said variance value of said differential frame energy.

12. The code book or codec changing method according to claim 11, wherein said step of identifying identifies said input signal as a music signal when said variance value of said pitch strength is lower than a first threshold value specified based on said average of the pitch strength, and identifies said input signal as a speech signal when said variance value of said pitch strength is higher than a second threshold value, wherein said second threshold value is higher than said first threshold value, and when said variance value of said pitch strength is between said first and second threshold values said identifying means identifies said input signal as said music signal when said variance value of said differential frame energy is lower than a third threshold value specified based on said average of said differential frame energy, and identifies said input signal as said speech signal when said variance value of said differential frame energy is higher than or equal to said third threshold value.

* * * * *